US009378747B2

(12) United States Patent
Arteaga et al.

(10) Patent No.: US 9,378,747 B2
(45) Date of Patent: Jun. 28, 2016

(54) METHOD AND APPARATUS FOR LAYOUT AND FORMAT INDEPENDENT 3D AUDIO REPRODUCTION

(75) Inventors: Daniel Arteaga, Barcelona (ES); Pau Arumi Albo, Barcelona (ES); Antonio Mateos Sole, Barcelona (ES)

(73) Assignee: Dolby International AB, Amsterdam, Zuidoost (NL)

( * ) Notice: Subject to any disclaimer, the term of this patent is extended or adjusted under 35 U.S.C. 154(b) by 74 days.

(21) Appl. No.: 14/398,060

(22) PCT Filed: May 7, 2012

(86) PCT No.: PCT/EP2012/058382
§ 371 (c)(1),
(2), (4) Date: Dec. 1, 2014

(87) PCT Pub. No.: WO2013/167164
PCT Pub. Date: Nov. 14, 2013

(65) Prior Publication Data
US 2015/0124973 A1 May 7, 2015

(51) Int. Cl.
*H04R 5/00* (2006.01)
*G10L 19/008* (2013.01)
*H04S 3/00* (2006.01)

(52) U.S. Cl.
CPC ..... *G10L 19/008* (2013.01); *H04S 3/00* (2013.01)

(58) Field of Classification Search
None
See application file for complete search history.

(56) References Cited

U.S. PATENT DOCUMENTS

| | | | | |
|---|---|---|---|---|
| 5,857,026 | A * | 1/1999 | Scheiber | H04S 3/00 381/18 |
| 2004/0105559 | A1* | 6/2004 | Aylward | H04R 5/02 381/103 |
| 2005/0105442 | A1* | 5/2005 | Melchior | H04R 3/12 369/83 |
| 2008/0298597 | A1* | 12/2008 | Turku | H04S 5/00 381/27 |
| 2010/0014692 | A1 | 1/2010 | Schreiner | |
| 2010/0092014 | A1 | 4/2010 | Strauss | |
| 2011/0116638 | A1* | 5/2011 | Son | H04S 3/008 381/1 |
| 2011/0216906 | A1* | 9/2011 | Swaminathan | H04R 5/00 381/17 |
| 2014/0140515 | A1* | 5/2014 | Lee | H04S 5/005 381/17 |
| 2014/0180684 | A1* | 6/2014 | Strub | G10L 19/008 704/211 |

FOREIGN PATENT DOCUMENTS

| | | |
|---|---|---|
| CN | 101502131 | 8/2009 |
| CN | 101843114 | 9/2010 |
| EP | 2373054 | 10/2011 |
| JP | 2011-510589 | 3/2011 |
| RS | 1332 U | 8/2013 |
| WO | 2011/104418 | 9/2011 |

OTHER PUBLICATIONS

Stanojevic, T. et al "The Total Surround Sound System", 86th AES Convention, Hamburg, Mar. 7-10, 1989.
Stanojevic, T. et al "Designing of TSS Halls" 13th International Congress on Acoustics, Yugoslavia, 1989.

(Continued)

*Primary Examiner* — Thang Tran

(57) ABSTRACT

A method for encoding audio signals, for later reproduction in arbitrary three-dimensional loudspeaker layouts, based on the generation of an intermediate channel-independent representation, which enables the creation, manipulation and reproduction of sounds with complex apparent size and shape, including multiple disconnected shapes.

15 Claims, 13 Drawing Sheets

(56) References Cited

OTHER PUBLICATIONS

Stanojevic, T. et al "TSS System and Live Performance Sound" 88th AES Convention, Montreux, Mar. 13-16, 1990.

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner

METHOD AND APPARATUS FOR LAYOUT AND FORMAT INDEPENDENT 3D AUDIO REPRODUCTION

TECHNICAL FIELD

The present invention relates generally to audio encoding, and in particular to audio reproduction in arbitrary three-dimensional loudspeaker layouts independent of the number and position of the loudspeakers.

BACKGROUND OF THE INVENTION

Different standards have been adopted by the content industry in the context of multichannel sound production, distribution, and playback. The first standards were related to the implementation of monophonic sound systems, based on one single independent audio channel. Subsequent standards evolved to stereo systems, based on two independent audio channels, then to 5.1 and 7.1 channels, based on 6 and 8 independent audio channels respectively. In particular, the so-called 5.1 channel configuration has been adopted by a large portion of cinema theatres, and it has witnessed a considerable deployment in the home market. The natural evolution of these standards, achieved by the stepwise addition of audio channels, has led to, on one hand, consecutive enhancements in the spatial sound perception by the audience, and, on the other hand, in an increased creative freedom for content creators.

In an attempt to continue these enhancements both for content creators as well as content consumers, proposals have coexisted to adopt standards based on multichannel layouts with more and more independent audio channels, like the 10.2 system proposed by THX's founder Tomlinson Holman, and the 22.2 system proposed by Kimio Hamasaki, from the Japanese broadcaster NHK. All such systems are normally referred to as 3D layouts, as they include loudspeakers at different heights, and are capable of delivering better experiences than present 5.1 or 7.1 systems.

However, all such proposals share a number of drawbacks. They all require complex procedures already at the content production phase, since content has to take into account the variety of possible reproduction formats while being produced. Content production has to cater for the most complex reproduction format as well as for the simpler ones. In content production for layouts with many loudspeakers, the complexity is large, as sound engineers need to constantly take decisions which require coping with the whole layout in mind, such as how to route a particular given audio track to a particular loudspeaker (for example, the top-center-far-left channel). This mental exercise limits their creativity by focusing on technical tasks rather than aesthetical processes relating to the reproduced sound image.

Loudspeaker installation difficulty is another drawback of all mentioned prior art systems. All such multichannel formats require precise location of every loudspeaker in the reproduction venue, following a given standard, be it a professional cinema or a home environment. This is a complex and time consuming task requiring the assistance of expert sound technicians. In many cases, correct positioning of all loudspeakers is simply impossible due to specific venue constraints, like location of fire sprinklers, columns, small ceiling height, air-conditioning pipes, and so forth. This disadvantage in loudspeaker layout is bearable in systems with a low number of channels, like stereo. However it becomes hard to cope with, and therefore unrealistic, as the number of channels increases.

Certain developments have attempted to solve these problems by implementing audio workflows whereby content creation is completely decoupled from content reproduction. Such workflows are based on a new paradigm in which the production and postproduction processes are completely independent of the specifics of the reproduction layout. In particular, in such workflows, the output of post-production is a soundtrack, normally in digital support, whose generation is based on a variety of sound encoding techniques which do not depend on the number and location of the independent channels in the intended reproduction venues.

Early examples of such encoding techniques are Ambisonics and Vector-Based Amplitude Panning. Other examples of intermediate channel-independent encoding methods are disclosed by Jot and Pulkki. In these latter works, by dividing the audio recording in time-frequency bins, and analyzing the cross correlation among the different channels, a spatial location is assigned to each one of the time-frequency bins. One of the major drawbacks of these prior art methods is that the time-frequency decomposition inevitably produces audible processing artifacts which reduces the quality of the final reproduction. This limits the applicability of these methods in situations where only the highest quality reproduction is accepted. The audible processing artifacts are themselves also magnified as the number of channels increases. Hence the possibility of offering high quality reproduction in 3D environments using a plurality of channels is severely limited.

Many sound sources do not originate from a single point of space, but rather they have some intrinsic spatial extension, For instance, ambient sounds are frequently extended over a large spatial area. Another obvious example is the sound of a large truck, which is perceived as a noise extended over a wide area. However, all methods for channel-independent audio encoding exhibit limitations in the assignment, manipulation and reproduction of the apparent size of sounds, especially when complex sizes are intended. In particular, apparent sound shapes consisting of multiple disconnected areas, are very difficult, if not impossible, to attain with current existing audio encoding methods. Examples of such sound shapes consisting in multiple disconnected areas are the urban noise coming from different streets, or lateral reverberation sounds.

It is therefore necessary to provide solutions to the aforementioned drawbacks. In particular, it is desirable to encode sounds in a manner that is completely channel-independent, and therefore, reproducible in any arbitrary 3D loudspeaker layouts. It is also desirable to accomplish this without generating any audible artifacts. Furthermore, it is desirable to facilitate the creation and manipulation of sounds with complex apparent size, including the possibility of multiple disconnected shapes.

SUMMARY

It is therefore an object of the present invention to provide a solution to the above mentioned problems. In particular, it is an object of the present invention to provide embodiments referring to novel encoding and decoding techniques for processing audio signals for later reproduction in arbitrary loudspeaker layouts, including 3D loudspeaker layouts, wherein all or part of the above mentioned problems have been solved.

In one embodiment of the invention the solution is based on the generation of a channel-independent representation of the input audio signals, which enables simple and intuitive creation, manipulation and reproduction of sounds with complex apparent size, including the possibility of multiple disconnected shapes, and which does not generate any audible artifacts.

According to embodiments of the invention a method and device are provided for encoding at least one input audio signal into a channel-independent representation suitable for reproduction over arbitrary loudspeaker layouts comprising at least one output audio signal and associated metadata.

According to other embodiments of the invention a method and device are provided for decoding a channel-independent representation suitable for reproduction over arbitrary loudspeaker layouts comprising at least one output audio signal and associated metadata.

According to other embodiments of the invention a system and corresponding method are provided for generating, from at least one input audio signal, a channel-independent representation, and for generating, from a channel-independent representation, at least one output audio signal for reproduction over arbitrary loudspeaker layouts.

According to other embodiments of the invention, a computer program, and a computer readable medium embodying the computer program, for performing the different functions of the different aspects and embodiments of the invention are provided.

According to another embodiment of the invention a system and method are provided to integrate the different functions of the different aspects and embodiments of the invention in an audio post-production workflow, whereby a sound engineer generates the channel-independent representation as a result of a post-production process, to be delivered to different listening venues.

The invention provides methods and devices that implement various aspects, embodiments, and features of the invention, and are implemented by various means. For example, these techniques may be implemented in hardware, software, firmware, or a combination thereof.

For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof.

For a software implementation, the various means may comprise modules (e. g., procedures, functions, and so on) that perform the functions described herein. The software codes may be stored in a memory unit and executed by a processor. The memory unit may be implemented within the processor or external to the processor.

Various aspects, configurations and embodiments of the invention are described. In particular the invention provides methods, apparatus, systems, processors, program codes, and other apparatuses and elements that implement various aspects, configurations and features of the invention, as described below.

BRIEF DESCRIPTION OF THE DRAWING(S)

The features and advantages of the present invention will become more apparent from the detailed description set forth below when taken in conjunction with the drawings in which like reference characters identify corresponding elements in the different drawings. Corresponding elements may also be referenced using different characters.

DETAILED DESCRIPTION

From the following description, it will be understood by the person skilled in the art that although any one preferred aspect of the invention already provides solutions to at least some of the problems of the devices and methods of the prior art, the combination of multiple aspects herein disclosed results in additional synergistic advantageous effects over the prior art, as will be described in detail in the following.

Figure 1A:
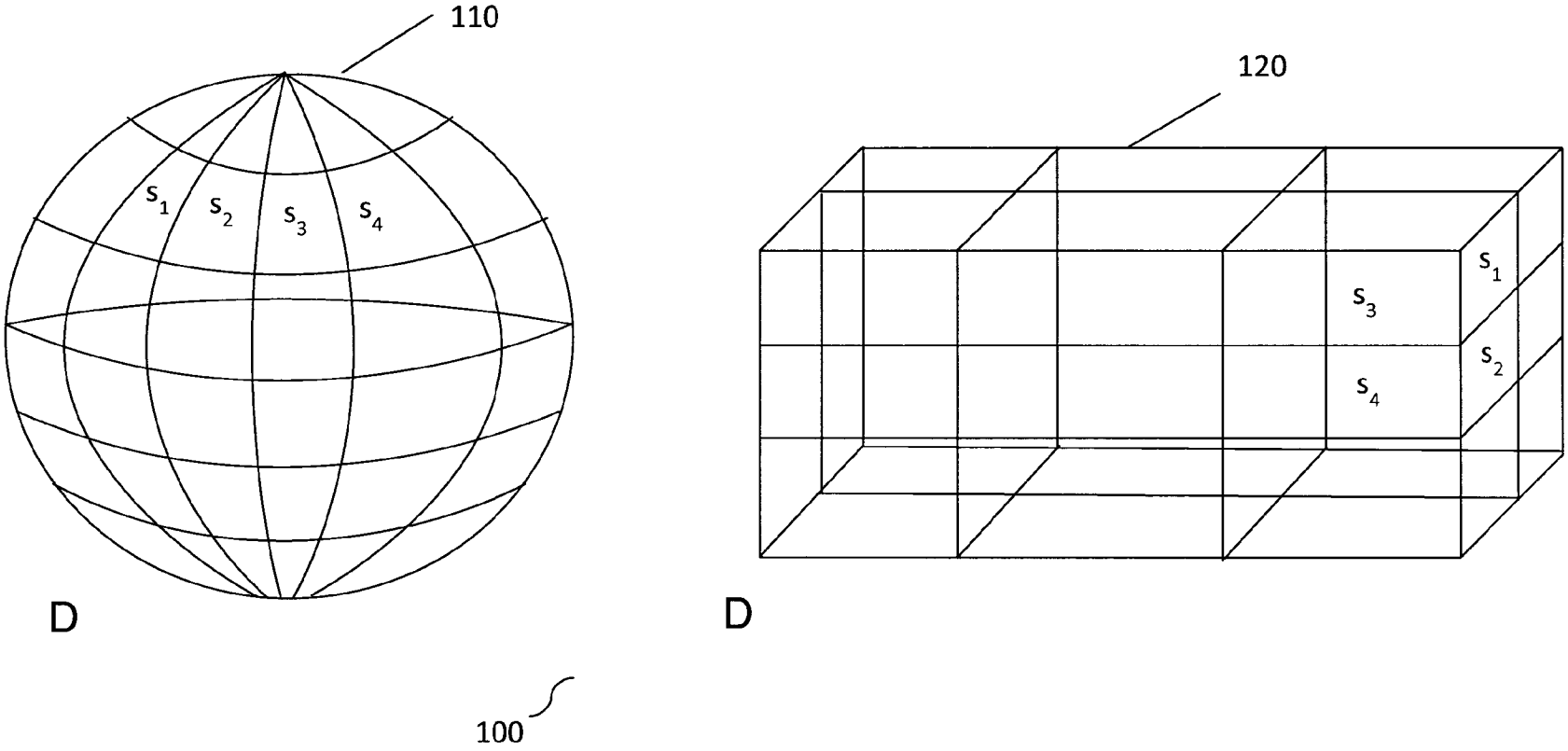
FIGS. 1A and 1B depict different abstract representations of the reproduction spaces according to an aspect of the present invention.
Figure 1B:
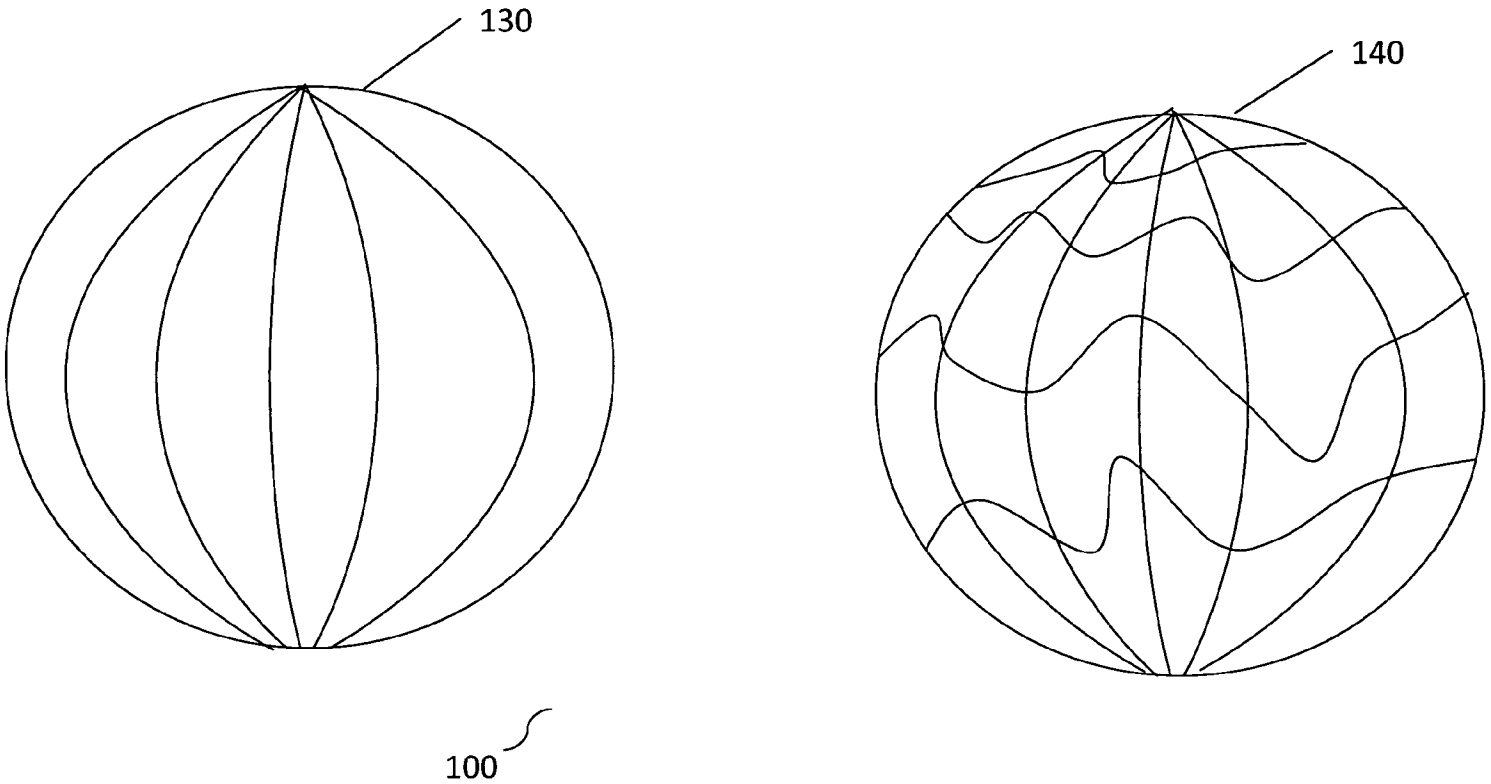

FIG. 1 depicts different abstract representations of reproduction spaces 100 according to an aspect of the present invention. D represents the space defined as the region surrounding potential listeners wherein the audio signals are to be reproduced for their listening. Space D may have any arbitrary shape, including spherical shape 110, or rectangular shape 120, as depicted in FIG. 1A. Rectangular space D 120 is well adapted to applications where content is to be mostly reproduced in rectangular geometric shapes such as cinema theaters or home theaters. On the other hand, spherical spaces D 110 are better suited for round shaped auditoriums, such as the ones found in planetariums, or even open spaced amphitheaters, or undefined areas. Other topologically equivalent shapes can be used at convenience. Space D is partitioned into K portions $s_1, s_2, \ldots s_K$, and the collection of all such portions is a partition set S. FIG. 1B depicts two examples of the same shape however with different partitions. Partition 130 has a different number of portions than partition 140. It will be apparent to the skilled artisan that other shapes are also possible, such as any polygon shape. Portions within the partition set S can have different shapes and areas. Furthermore, these partitions do not necessarily have to be regular, or homogeneous. Any user can generate as many partitions as desired, also manually, as depicted in partition 140, wherein the partitions have non-linear boundaries.

As mentioned, different aspects of the invention define different space D shapes best suited to a particular application. In different aspects of the invention each space D may be partitioned in different manners depending on the application needs. In one aspect, such as in partition 110, finer partitions S lead to higher resolution in shape and size, thereby providing a more accurate control of sound reproduction. In another aspect, such as in partition 130, coarser partitions S require less processing capacity and power thereby providing a less computationally intensive processing. In yet another aspect, such as in partition 140, partitions can be finer in a particular region of the space D, and coarser in other regions of the space D, in case more resolution is necessary in the former and less resolution is necessary in the latter. Such non-homogeneous space partitioning enables an optimization of resources, as quality is guaranteed where necessary, however processing capacity is saved when not strictly necessary.

Figure 2:
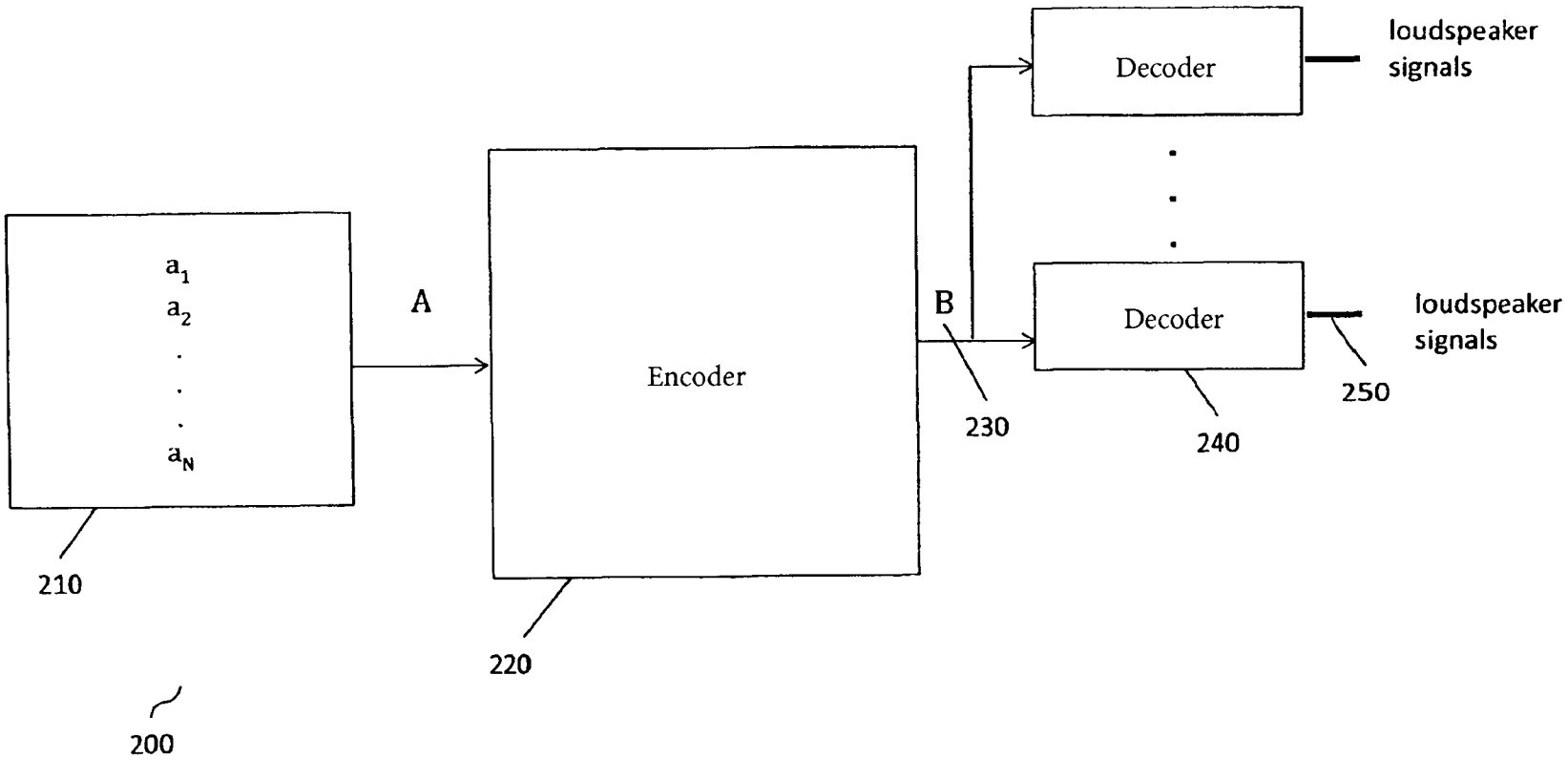
FIG. 2 depicts a system for channel-independent representation according to one embodiment of the invention.

FIG. 2 depicts a system 200 for channel-independent representation according to one embodiment of the invention. System 200 comprises an original set A 210 of audio signals $a_i$, where i=1 to N, which are encoded by channel-independent encoder 220, or encoding means, resulting in processed output audio signals. The input audio signals comprise the set of individual tracks or streams of a multichannel content, including but not limiting to stereo, 5.1, and 7.1 multichannel content. Channel-independent encoder 220 also generates metadata associated with the output audio signals comprising information describing space D and associated partition S. The resulting combination of output audio signals and associated metadata results in a set B 230 of processed signals which are suitable for reproduction in any reproduction format according to any standard as well as in any loudspeaker layout.

Once signal set B are decoded by decoder 240, or decoding means, the resulting signals 250 are fed to the chosen loudspeaker layout and reproduced therefrom. If decoder 240 is not configured with any particular parameters, a default parameter set decodes signals B to be reproduced according to a user-defined preference, such as 5.1, 7.1 or 10.1 system.

On the other hand, decoder 240 may also be configured with parameters which describe in detail the particular loudspeaker layout of a specific listening venue. The user can input the desired reproduction format as well as the loudspeaker layout information to the decoder, which in turn, without further manipulation or design, reproduces the channel-independent format for the intended theater space.

The channel-independent representation signal set B is generated by assigning and manipulating a spatial presence factor $m_{i,k}$ to every audio signal $a_i$ in set A of original audio signals, such that each factor $m_{i,k}$ relates every original audio signal $a_i$ with a given portion $s_k$ of the partition S of the space D that represents the region that surrounds potential listeners. In one aspect of the invention the presence factors $m_{i,k}$ may be time varying.

The relation between input audio and output audio can be represented by the expression output=$a_i \cdot m_{i,k}$ where i is an index referring to the $i^{th}$ input audio signal a, k is an index referring to the portion $s_k$ of the partition S, and m is the spatial presence factor. In this expression the channel-independent representation is generated as the set of all products $a_i \cdot m_{i,k}$, for all i and all k, one such product for every combination of original audio signals and portions in the partition set S.

In another configuration of the same embodiment, the relation between input audio and output audio can be represented by the expression output=

$$\Sigma_{i=1}^{N} a_i \cdot m_{i,k}.$$

Here the channel-independent representation is generated as the set of sums of $a_i \cdot m_{i,k}$ over all original audio signals, each sum corresponding to mixing all original audio signals in a given portion of the partition S, weighted according to their presence.

Figure 3:
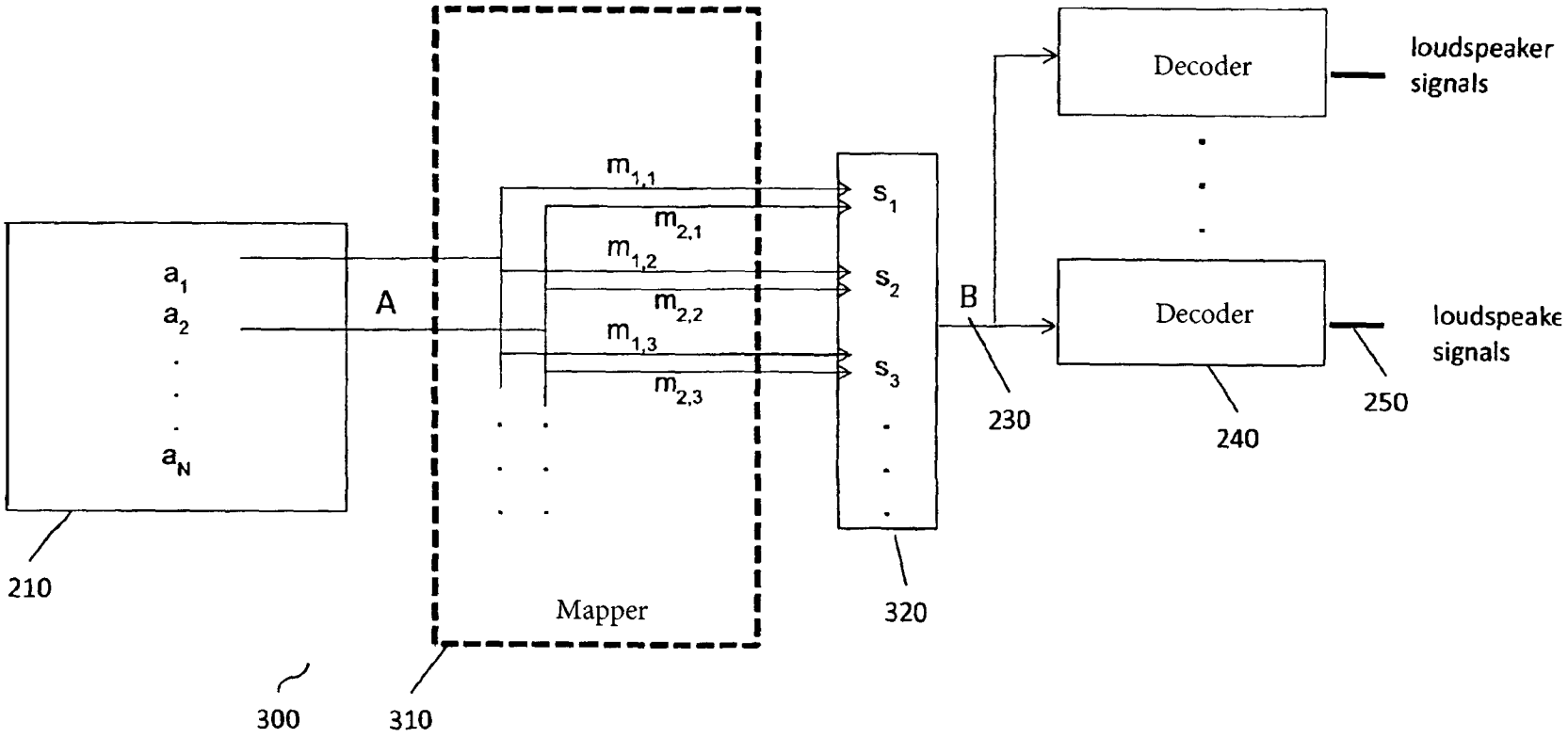
FIG. 3 depicts a system for channel-independent representation according to one aspect of the invention.

FIG. 3 depicts a system 300 for channel-independent representation according to one aspect of the invention. This aspect presents further details of the embodiment of FIG. 2. As can be seen, channel-independent encoder 220 can be viewed as a mapper 310, or mapping means, which maps each input audio signal A to a particular portion $s_1, s_2, \ldots, s_K$ of a partition set S (320) The collection of all relevant portions, together with the spatial presence factors, and information describing space D and associated partition S, composes output signal B, which is fed equally to the decoder 240 for audio reproduction.

Signal B may comprise all partition sets S making up a particular space D, or only a subset thereof. In cases where it is only necessary to cover a certain area or region of a particular space D, only a particular one, or group of partitions sets S, may be generated. Based on the generated signal B the decoder, or decoders, will be able to provide corresponding loudspeaker signals suitable to the particular reproduction environment. In one aspect, signal B comprises a subset of partitions S which cover the full scope of a reproduction environment. In another aspect, a subset of partitions S does not cover the full scope of a reproduction environment, and the decoder user default partitions to provide a minimum reproduction format for the remaining parts of the environment, for example, stereo, or 5.1, or 7.1, or 10.1 system.

Every element $m_{i,k}$ can be understood as representing an amount of presence of an i-th audio signal into the particular k-th portion of space D. In one configuration of all embodiments and aspects of the invention, the amount of presence is expressed as a limitation of $m_{i,k}$ to real numbers between 0 and 1, whereby 0 represents no presence at all, and 1 represents full presence. In another aspect the amount of presence is expressed using a logarithmic, or decibel, scale, wherein minus infinity represents no presence at all, and 0 represents full presence.

In another aspect of the present invention, the elements $m_{i,k}$ may be time-varying. In this aspect, the variation of the values of these elements with time causes a sensation of motion of the corresponding audio signals to the end listeners. The time varying nature of the spatial presence factors may either be set manually by a sound engineer or automatically following a predetermined algorithm. In one aspect of the invention, the manual setting of presence factors enables the live adaptation of reproduced sound to a particular audience experience.

One example wherein the time-varying nature of this aspect is useful is audio reproduction in concert halls. In case of concert halls, the sound engineer can, on one hand, reproduce a pre-recorded audio signal to suit the environment and particular loudspeaker layout optimally. On the other, while ongoing reproduction takes place, the sound engineer, or even musician, can partake in creating an immersive audio experience by varying the spatial presence factors of different regions of space D in a creative manner. This could enhance the concert experienced by participants listening to a live DJ, who, using feedback received directly from the audience, decides to interact with them musically by varying the shape, volume, and region of different instrument channels without any latency involved.

Another example wherein the time-varying nature of this aspect is useful is technical compensation for cases wherein the reproduction environment has a fixed loudspeaker layout not particularly suited for producing the best audio effects from a particular recording. In such case, the sound engineer can compensate for areas of space D with low audio coverage, to produce a higher audio presence in these areas, and on the other hand reduce the audio presence in areas in direct proximity to the loudspeakers, hence normalizing the listening experience throughout the whole space D.

Figure 6:
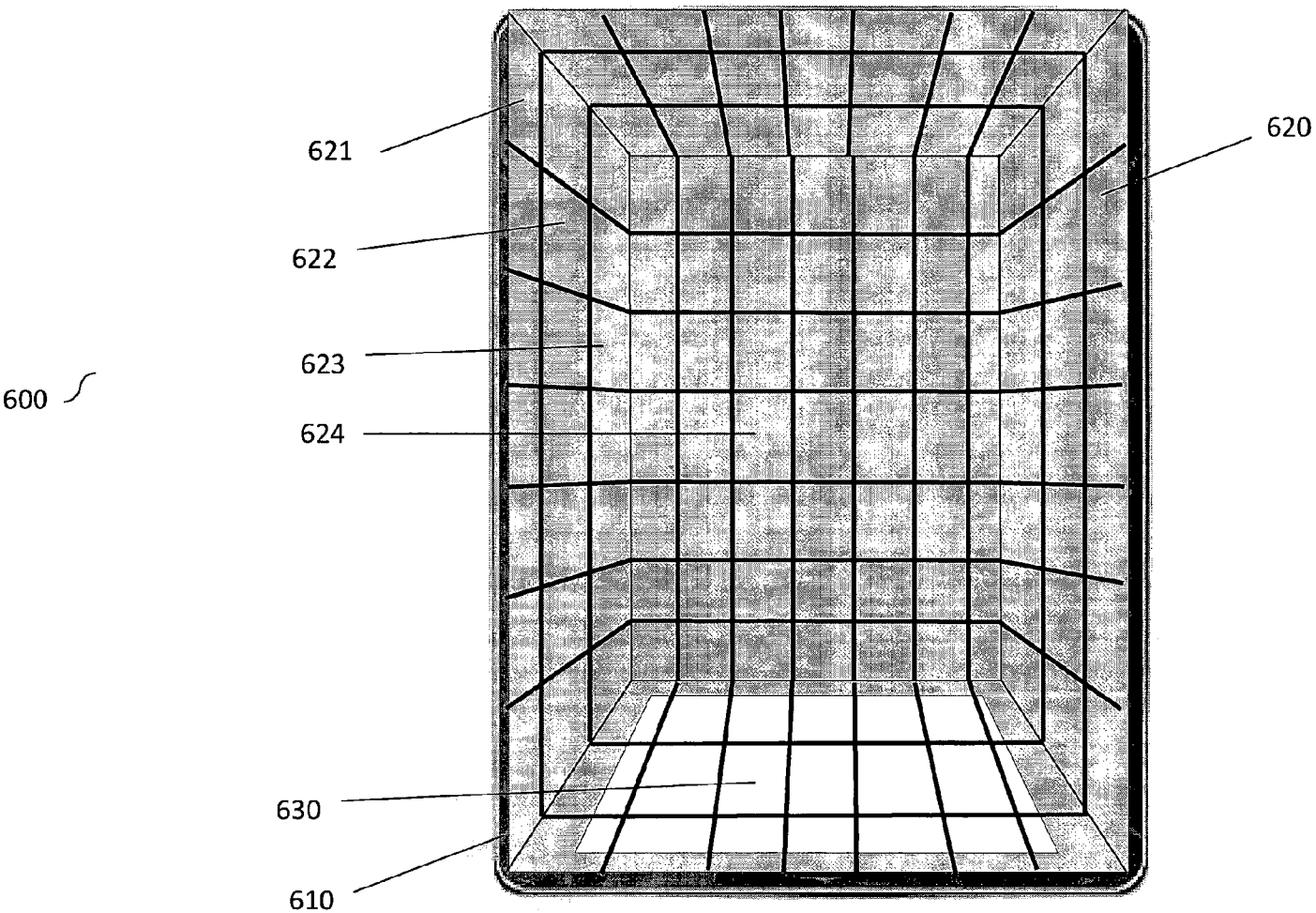
FIG. 6 depicts a tactile user interface according to one aspect of the present invention.

FIG. 6 depicts a user interface view 600 according to one aspect of the present invention, wherein the creation and manipulation of the spatial presence factors $m_{i,k}$ is done intuitively by means of a tactile interface 610. The interface shows a view of a cinema from beneath the cinema hall. In this particular configuration, the hall is represented via the rectangular space D model divided into a plurality of partitions 620. Portion 624 is a portion of partition set S located at the cinema ceiling, and portions 621, 622, and 623 are portions located at the cinema side wall. The cinema screen 630 is shown in white at one end of the hall.

Figure 7:
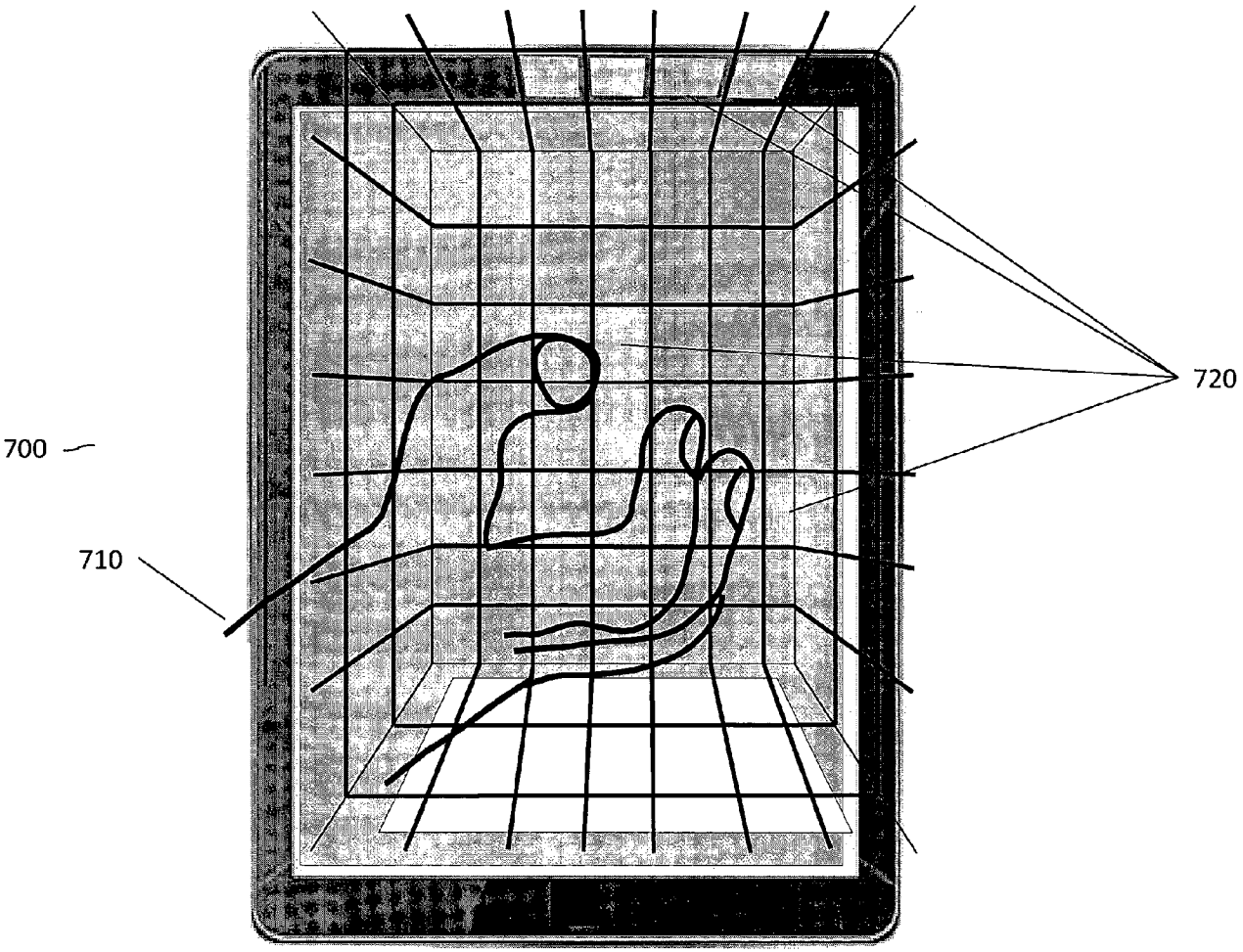
FIG. 7 depicts a tactile user interface according to another aspect of the present invention.

FIG. 7 depicts the same user interface of FIG. 6 being manipulated by a user, such as a sound engineer or musician. The user's hand 710 and therefore fingers can move throughout the tactile interface thereby assigning different values to the spatial presence factors m. This is done intuitively, in the sense that the user interface facilitates easy manipulation by the end user, however the user does not have to be an experienced sound engineer. The portions 720 being assigned by the fingers, in light colour, define and locate a particular audio signal, or can define and locate different audio signals to different portions thereby resulting in a highly complex apparent sound size and shape. The shape is easily defined and manipulated, even when, as in this case, it is made of two disconnected parts. In one aspect of the invention, the algorithms implemented by the system assign high spatial presence values to the portions selected by the finger touch, in light colour, and low values to the other portions, in darker colour.

In one particular aspect, the spatial presence factors are generated by assigning intermediate values to factors in intermediate zones. Intermediate zones are defined as zones between finger-selected zones with high factor values, and far removed zones with very low factor values. In this manner a desired degree of continuity in between different portions of S is ensured, guaranteeing a more pleasing listening experience in the whole space D.

The different possible combination of time-varying values, applied to different portions, facilitates the reproduction of extremely complex audio images in a 3D environment to even inexpert users. Hence the system enables users to, awarely or unawarely, effortlessly edit the values for $m_{i,k}$. This in turn facilitates the automatic conversion of any input audio format into any output audio format independent of reproduction layout or number of channels to be performed by the different embodiments of the invention.

Figure 4:
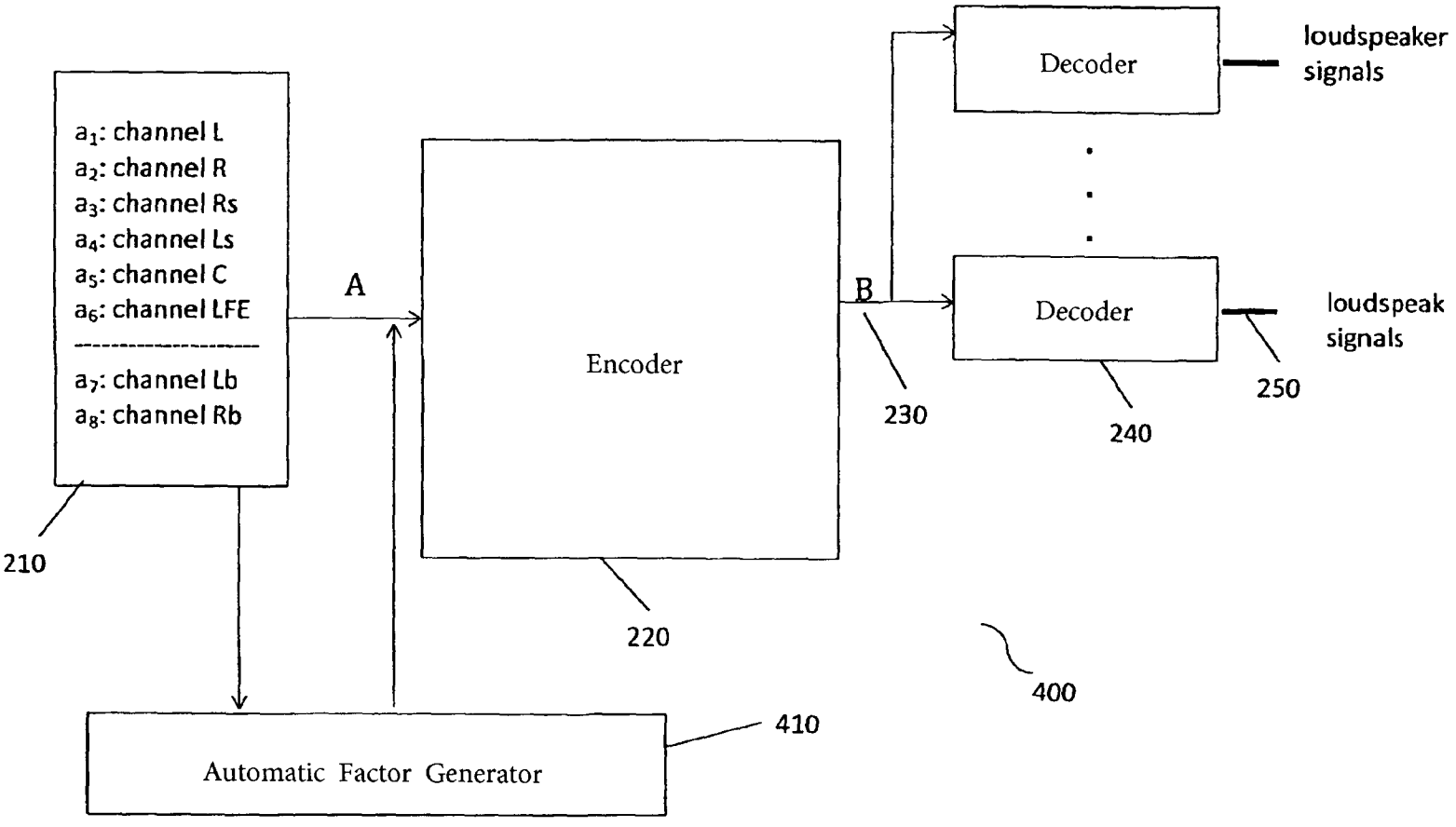
FIG. 4 depicts a system for channel-independent representation according to one aspect of the invention.

FIG. 4 depicts a system 400 for channel-independent representation according to one aspect of the invention, which is useful for upmixing standard 5.1 and 7.1 content to 3D; other input formats are also possible by straightforward extension of the following. This view depicts an original set of input 5.1 or 7.1 channels. For 5.1, the first five channels from a typical 5.1 system, often referred to as left L, right R, center C, left-surround Ls and right-surround Rs, are considered as original independent audio signals. The same applies for 7.1, where the two extra channels are often referred to as left-back Lb and right-back Rb. An additional low frequency effects LFE, or subwoofer, signal, is also often present. In this example case eight original independent audio signals are considered.

Figure 8:
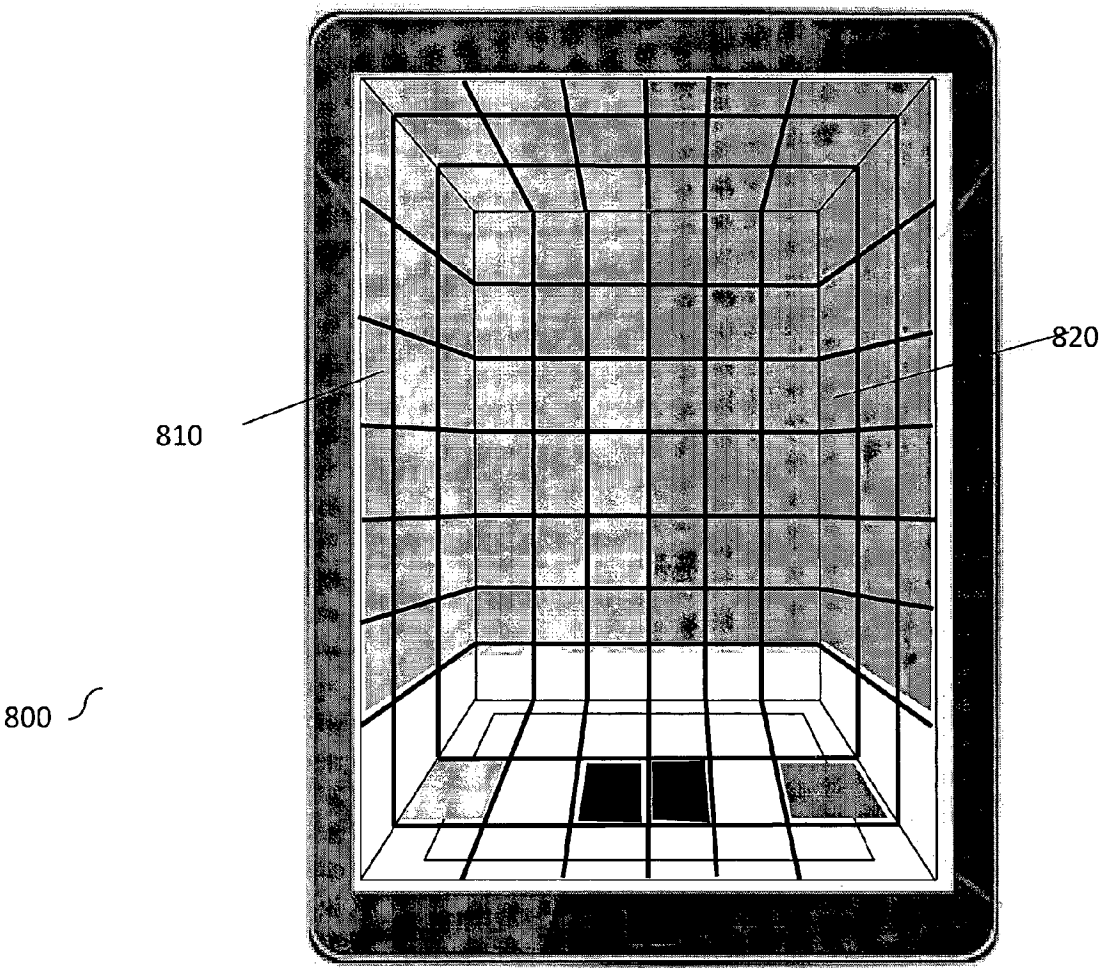
FIG. 8 depicts a tactile user interface when the pre-processing upmixing stage is applied according to one embodiment of the invention.

Each signal is encoded into a channel-independent representation by means of the various aspects and embodiments described. Suitable choices of the coefficients $m_{i,k}$ help increasing the immersive effect. For example, for 5.1, the left-surround channels are assigned sizes and shapes following the concept illustrated in FIG. 8, where the left-surround channel is identified by partition set 810 and the right-surround channel is assigned sizes and shapes identified by partition set 820.

The capability of the present invention to generate complex shapes proves essential in this case, as it avoids situations that would degrade and produce audible artifacts. For example, the two surround channels do not overlap in space; this allows keeping both left-right hemispheres surrounding the audience as decorrelated as possible, which results in pleasant natural sound perception. It also avoids the mixing of both signals, which would otherwise lead to annoying comb-filtering artifacts. Similarly, both surround channels are prevented from reaching the screen area 830, which would also produce unwanted effects, like reduced intelligibility of dialogues. Therefore the present invention improves the quality of sound images when upmixed from a stereo system, especially in environments requiring a high number of loudspeakers.

Figure 9:
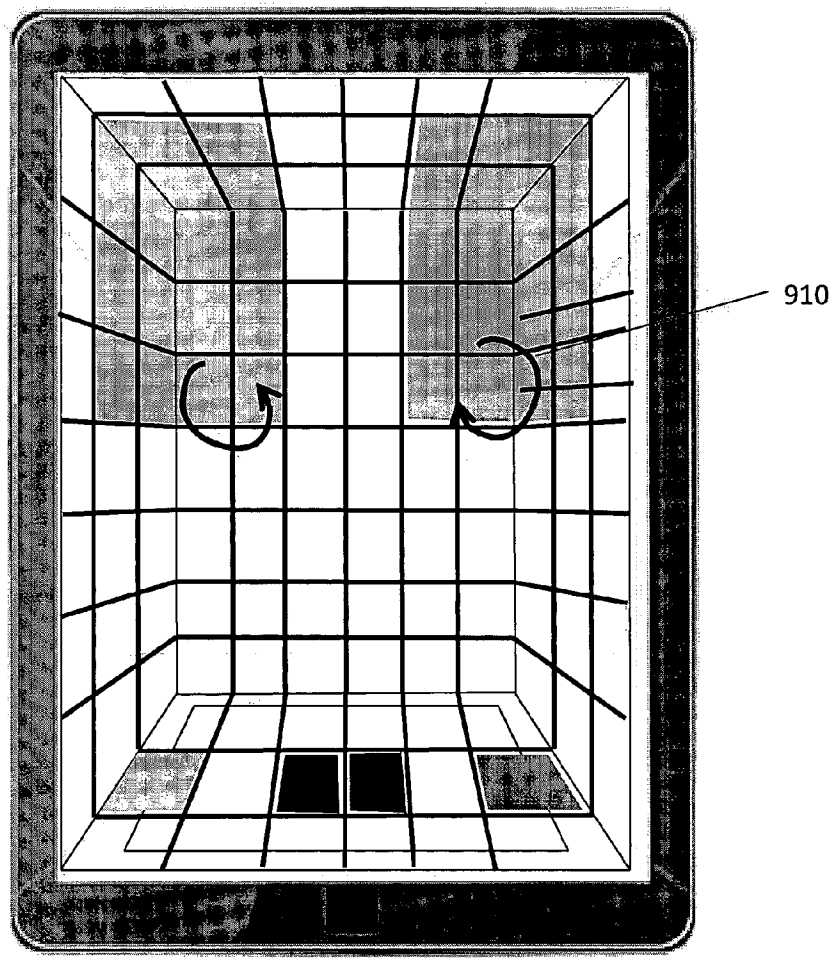
FIG. 9 depicts a tactile user interface when the pre-processing upmixing stage is applied according to another aspect of the invention.

FIG. 4 also shows an optional enhancement consisting on the use of an automatic factor generator 410, or factor generation means, which generates time-varying spatial presence factors $m_{i,k}$, the generation algorithm being based on, for example, predefined trajectories or on the result of an analysis of the input audio channels. FIG. 9 depicts suitable time-varying factor generations that enhance the immersive effect. In this aspect, the properties related to the location, size and shape of some of the channels are time-varying, and based on predefined variations of the map coefficients, for example, by making the two surround channels move in loop trajectories 910. In another embodiment, the time variation is based on an analysis of the audio in the original channels. In a first step the amount of energy present in all input channels is determined. Then the channels are identified according to their property, whether they are simple left/right stereo channels or one of 5.1/7.1 channels. Finally, the values generated for the spatial presence factors can be set to be dependent on the result of the changes in energy estimated.

For example, in case the channels are surround channels, a determination is made to estimate the relative proportion of total acoustic energy present in the surround channels with respect to the remaining channels. Finally the motion of the reproduced image of the two surround channels is accelerated throughout space D based on this relative energy estimation. This causes the auditory scene motion to be synchronized with the surround level such that, depending on the original 5.1/7.1 content, an enhanced realism and spectacularity results. Other features, different from energy estimation, extracted from an analysis of the input channels may be used.

Figure 5:
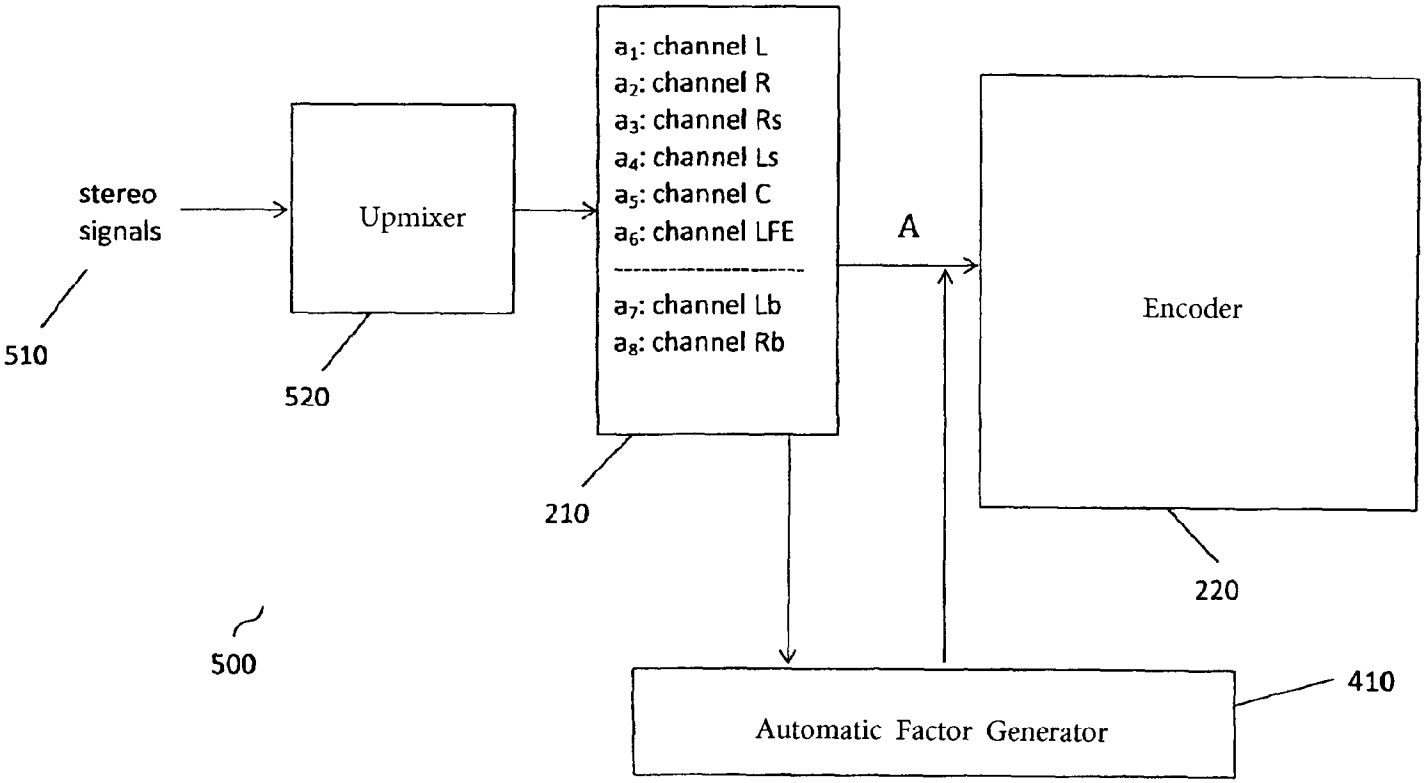
FIG. 5 depicts the integration of a pre-processing stage into the system according to an embodiment of the present invention.

FIG. 5 depicts an embodiment of the present invention wherein the system of previous embodiments is integrated with a pre-processing stage 500 typical of many audio reproduction setups. Since many recordings exist only in a 2-channel stereo format 510, an upmixer 520 may be integrated to upmix the stereo to 5.1, or 7.1, resulting into a set of initially upmixed multichannel signals. After this initial upmix, the same aforementioned audio processing stages of previous embodiments and aspects apply to encode in a channel-independent representation the initially upmixed multichannel signals.

Figure 10:
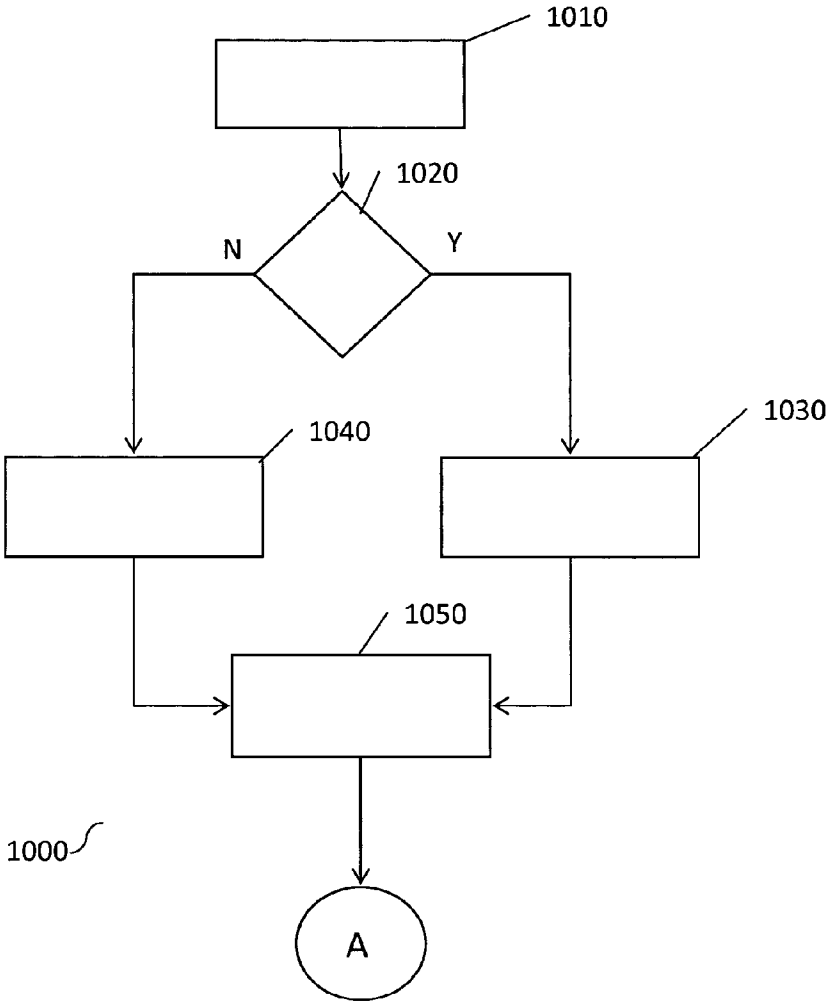
FIG. 10 depicts a method for the selection of the representation D best suited for a particular reproduction environment according to one embodiment of the present invention.

FIG. 10 depicts a method 1000 for the selection of the representation D best suited for a particular application according to one embodiment of the present invention. In step 1010 the user is prompted for information or directly for a selection from a list of possible space D shapes and topologies best suited for the particular reproduction environment in which the 3D audio is to be implemented. The user may select 1020 from a list comprising circular, rectangular, squares, or any other polygons. Depending on the selected topology, the corresponding space D shape is extracted 1030 from memory and visualized in the tactile user interface for the user's facility.

In case no selection is input by the user, the method proceeds to step 1040 where a default representation is selected (for example, a sphere) as the best suited shape for an unknown application. Consequently the corresponding default shape D is extracted 1040 from memory and visualized in the tactile user interface for the user's facility. After space D extraction and visualization, in step 1050 the user is presented with different preset partitions of the chosen space D, each with different adjustable portion sizes. Depending on the application, the user can select a very fine partition, with very small individual portions, or coarser partitions, with larger individual portions. The algorithm then proceeds to the remaining encoding steps. ("A")

Figure 11:
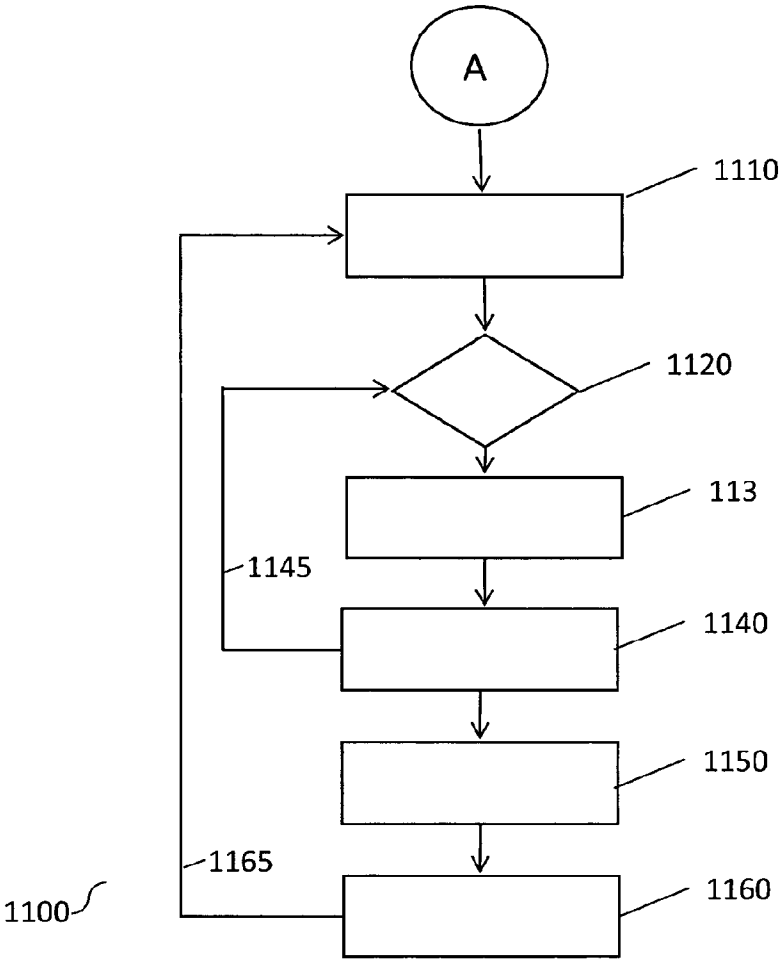
FIG. 11 depicts a method for implementing the channel-independent algorithm according to an embodiment of the invention.

FIG. 11 depicts a method 1100 for implementing the channel-independent algorithm according to an embodiment of the invention. Following topology and partition selection and configuration after step 1050 of method 1000, (labeled as "A"in FIG. 11) the user is prompted 1110 via the display for input on select zones where special processing is required. The user is able to provide this input by touching the tactile user interface, for example, with the fingers, or with any other suitable touching device or means. The partitions S in which contact is detected are identified 1120 and classified as selected zones.

Once the select zones are identified, the best suited spatial presence factor M-scale is selected 1130. It is from this scale that values for the factor m will be extracted. In step 1140 the value of m for that particular input audio channel is determined. This process is repeated 1145 until a full matrix M for all input audio channels is determined for all portions and partitions of space D. If the result of step 1120 is that no user input is detected, the algorithm continues by default to an intermediate value of the presence factor m to apply to all input audio channels independent of partition set or portions within space D.

The process for assigning a spatial presence to each input audio channel can be time-varying, by simply allowing the user to move his fingers while touching the tactile user interface, thus generating time-varying spatial presence coefficients, and optionally recording the corresponding time history of every coefficient in a time-line stream of events, as is standard in sound post-production with audio workstations and mixing consoles.

Once the matrix is full, in step 1150 the mapping between input audio signal set A and output audio signal set B is performed as described. This mapping comprises performing a smooth transition between select zones with high values for m and non-select zones with low values for m. In one aspect this smooth transition may be performed likewise by choosing consecutive values for m from the same selected M-scale, or from a different one, depending on user selection.

Finally, once the mapping of all partitions sets and portions of space D has been completed, associated metadata comprising spatial presence factors describing space D and partitions S is generated. The metadata together with the output signals result in the complete set of output audio signals B ready to be further processed 1160 by audio decoders and fed to the loudspeakers present in the particular venue. The method then returns 1165 to initial step 1110 in order to update its information about user tactile input, thereby yielding a dynamic algorithm running in real-time. Method 1100 is therefore an iterative algorithm which integrates user instructions into a time-varying and adaptive encoding of input audio signals A into a channel-independent representation B which solves the problems identified in the prior art.

Figure 12:
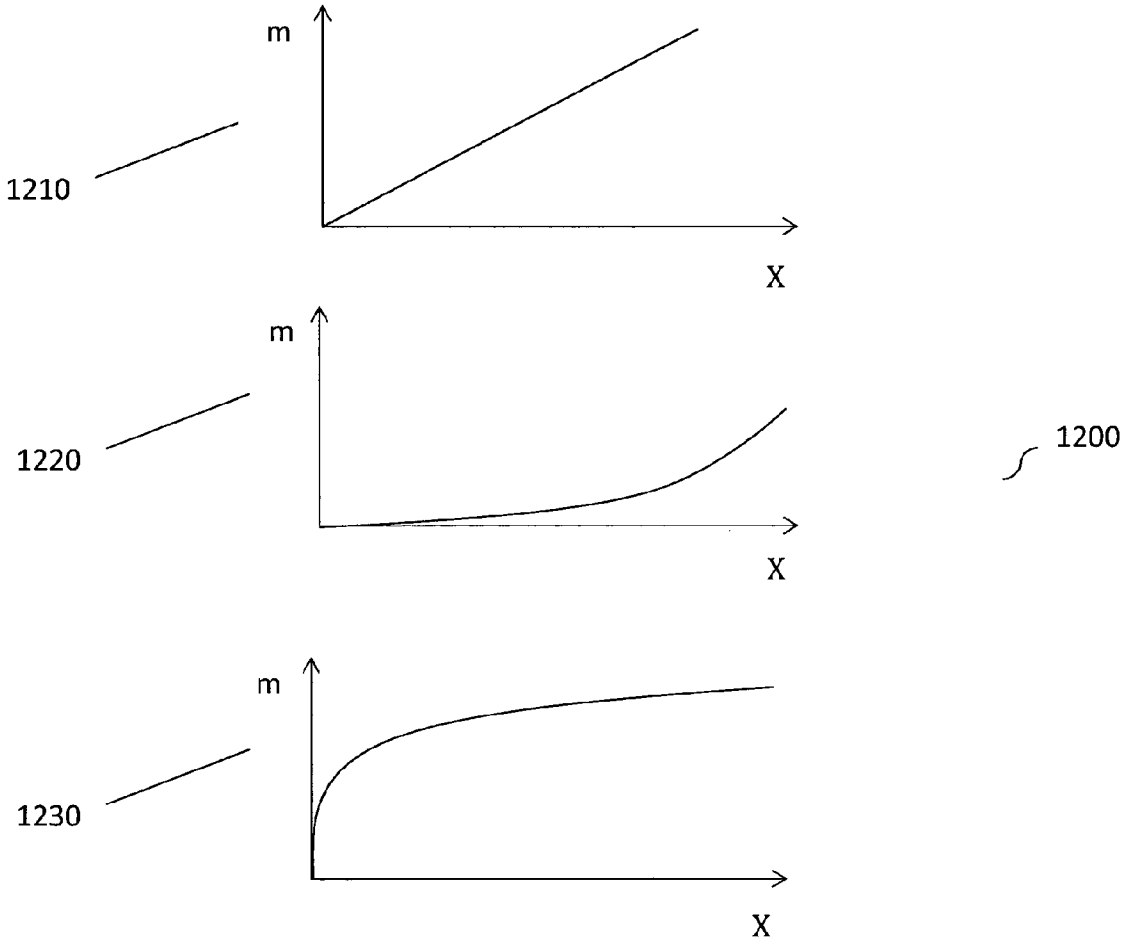
FIG. 12 depicts three examples of spatial presence factor M-scales.

FIG. 12 depicts three examples of spatial presence factor scales 1200. The scales have in their vertical axis the range of values which the spatial presence factor m can adopt. The maximum value for m can be set depending on user selection. It can either vary between 0 and 1, or 0 and any other value, such as 100 or 1000. The horizontal axis X is a parameter which can represent a number of factors relevant for immersive sound image enhancement.

In one aspect X represents a relational parameter which increases in value as the number of neighbouring selected zones increases. Hence an isolated portion will have a lower value of m than a group of portions. Likewise, within the group of portions, the center ones are assigned the highest value for m than other portions of the periphery.

In another aspect X represents the distance of the selected portion from another point Z in space D, for example, the front screen of a cinema, the side walls, a particular predefined area with particular echo effects produced by the architecture of the venue. Hence the value of m assigned is based on the distance of the selected portion from this point Z.

In another aspect X represents the relative acoustic energy present in that selected portion in comparison to the full energy present in all input audio signals A of all portions. Therefore a higher value for m is assigned to high relative energies, increasing thereby the spatial presence of a particular channel temporarily exhibiting high energy sound effects.

In another aspect X represents a pressure parameter. In other words, as the user performs tactile contact, the differences in exerted pressure are translated to the horizontal axis of the M-scale. In this aspect, the larger user pressure exerted on the tactile interface is translated to a corresponding high value for m, such that the more pressure is sensed on the tactile interface, a higher pressure parameter is assigned to that particular partition S, or portions s of a particular partition S. Therefore a higher spatial presence is forced in that specific region, independent of the inherent characteristics of the input audio signals. All of these aspects therefore receive information from the user in an intuitive and effortless manner.

As an example of different M-scale possibilities, FIG. 12 represents one linear and two non-linear functions relating the determined value of m based on the different possible parameters X described. In the first linear M-scale 1210, the values of m increases directly proportional to a corresponding increase in value of parameter X.

In the second non-linear M-scale 1220, the value of m increases as a logarithmic function with respect to a corresponding increase in the value of parameter X. Here, a high value of m is assigned once a relatively high predetermined threshold is exceeded. In this aspect, the spatial presence of the particular audio input will be enhanced only once the particular parameter is proximal to its maximum values as defined by the predetermined threshold.

In case X represents a relational parameter, a corresponding high value of m is assigned to selected portions only when a threshold representing a high number of grouped selections is exceeded. In such case the threshold is user predefined, or set to a default of 4, representing 4 fingers. Therefore if more than 4 fingers are used, it is understood that a special significance is intended in the selected zone, translating into a higher spatial presence. In case X represents distance, a corresponding high value of m is assigned to selected portions far away from the predetermined point Z. This could be useful, for example, when a particular low immersive zone is defined for people with different needs, such as children, or spectators with auditory sensibilities. In case X represents relative acoustic energy, once a predetermined threshold is exceeded, a corresponding high value for m is assigned to correctly reflect the spectacular sound effect the high energy input signal is representing. Finally, in case X represents tactile pressure, only once the pressure exceeds a certain threshold are high m values assigned. This is useful in situations where tactile behavior changes from user to user who press with different strength. It therefore adapts to the user in question.

In the third non-linear M-scale 1230, the value of m increases as a logarithmic function with respect to a corresponding increase in the value of parameter X, however the relation changes with respect to the previous non-linear scale 1220. Here, a high value of m is assigned once a relatively low predetermined threshold is exceeded. In this aspect, the spatial presence of the particular audio input will be enhanced immediately once the particular parameter is proximal to a relatively low value as defined by the predetermined threshold.

In case X represents a relational parameter, a corresponding high value of m is assigned to selected portions as soon as a threshold representing a low number of grouped selections is exceeded. In such case the threshold is user predefined, or set to a default of 2, representing 2 fingers. Therefore if more than 2 fingers are used, it is understood that a special significance is intended in the selected zone, translating into a higher spatial presence. This aspect also enables more than a single portion to be selected via a swipe finger action. In case X represents distance, a corresponding high value of m is assigned to selected portions close to a predetermined point Z. This could be useful, for example, to amplify the immersive experience is zones far away from the optimum loudspeaker hotspot. In case X represents relative acoustic energy, once a predetermined threshold is exceeded, a corresponding high value for m is assigned to correctly reflect the spectacular sound effect the high energy input signal is representing. However, in this case, the method would be highly reactive to any small variations in input energy due to the low threshold of the logarithmic scale. Finally, in case X represents tactile pressure, once the pressure exceeds a low threshold are high m values assigned. This is useful in situations where the user requires performing delicate actions with low pressure touches. It therefore adapts to the user in question.

It is to be understood by the skilled person in the art that the disclosure of the various embodiments of the invention is intended as non-limitative preferred examples and realizations of the inventions, and therefore features of different embodiments may be readily combined within the scope of the general inventive concept described.

It is to be understood that the embodiments described herein may be implemented by hardware, software, firmware, middleware, microcode, or any combination thereof. When the systems and/or methods are implemented in software, firmware, middleware or microcode, program code or code segments, a computer program, they may be stored in a machine-readable medium, such as a storage component. A computer program or a code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted using any suitable means including memory sharing, message passing, token passing, network transmission, and so forth.

For a software implementation, the techniques described herein may be implemented with modules (e.g., procedures, functions, and so on) that perform the functions described herein. The software codes may be stored in memory units and executed by processors. The memory unit may be implemented within the processor or external to the processor, in which case it can be communicatively coupled to the processor through various means as is known in the art. Further, at least one processor may include one or more modules operable to perform the functions described herein.

For a hardware implementation, the various logical blocks, modules, and circuits described in connection with the embodiments disclosed herein may be implemented of performed with a general purpose processor, a digital signal processor (DSP), and application specific integrated circuit (ASIC), a field programmable gate array (FPGA), or other programmable logic device, discrete gate or transistor logic, discrete hardware components, or any combination thereof designed to perform the functions described. A general-purpose processor may be a microprocessor, but in the alternative, the processor may be any conventional processor, controller, microcontroller, or state machine.

The methods or algorithms described may be embodied directly in hardware, in a software module executed by a processor, or a combination of the two. A software module may reside in RAM memory, flash memory, ROM memory, EPROM memory, EEPROM memory, registers, hard disk, a removable disk, a CD-ROM, or any other form of storage medium known in the art.

Those skilled in the art should appreciate that the foregoing discussion of one or more embodiments does not limit the present invention, nor do the accompanying figures. Rather, the present invention is limited only by the following claims.

The invention claimed is:

1. A device for encoding an input audio signal into a channel-independent representation comprising a multichannel output audio signal for reproduction over a multiple loudspeaker system, the device comprising:

a receiver that receives the input audio signal comprising a plurality of individual channels, N;

an interface that defines a space D covering a target audience and for partitioning the space D into a plurality of portions k independent from the plurality of channels N;

a processor that generates at least one spatial presence factor m for each combination of an input audio channel and portion k, wherein each factor m quantifies a degree of presence of each input audio signal into each portion k of space D; and a processor that maps the input audio signal to the output audio signal, for reproduction within the portions k, based on the value assigned to each spatial presence factor m.

2. The device of claim 1, further comprising:

a processor that generates metadata comprising the at least one spatial presence factor m; and a processor that associates the metadata with the output audio signal.

3. The device of claim 2, wherein the metadata associated with the output audio signal further comprises information describing the space D surrounding the intended audience and a partition of space D into the plurality of portions and wherein the space D is defined by selecting a space D with an arbitrary shape, a spherical shape, a rectangular shape, or any other surface.

4. The device of claim 2, wherein the space D is divided into finer portions, or coarser portions, or a combination of finer and coarser portions, and wherein the portions can be of regular or irregular shapes.

5. The device of claim 2, wherein each factor m is generated by assigning a value manually or automatically, and wherein the value assigned to each factor m is fixed or time-varying, the time variance being determined manually, or following preset instructions, or being generated automatically depending on the content of the input audio signals.

6. The device of claim 2, wherein a particular portion of the space D is selected by detecting contact in a tactile user interface wherein the space D, or a part of it, has been displayed.

7. The device of claim 6, wherein the spatial presence factor m corresponding to each selected portion is assigned a high value, and the remaining portions are assigned gradually diminishing lower values.

8. The device of claim 7, wherein the value assigned to each factor m of a remaining portion increases proportionally to the number of neighbouring selected portions.

9. The device of claim 7, wherein the value assigned to each factor m of a remaining portion decreases proportionally to the distance from a selected portion.

10. The device of claim 7, wherein the value assigned to each factor m of a remaining portion increases proportionally to the relative acoustic energy present in a selected portion, wherein the relative energy is the acoustic energy in comparison to the total amount of acoustic energy in all input audio signals of all portions.

11. The device of claim 7, wherein the value assigned to each factor m of a selected or remaining portion increases proportionally to the tactile pressure sensed on the selected portion of the tactile user interface.

12. The device of claim 7, wherein the input audio signals comprise only two individual channels of a stereo track, the device further comprising pre-processing means for upmixing the two input audio signals to 4.0, 5.1 or 7.1 audio signals containing respectively four, six and eight channels, prior to the generation of the channel-independent representation.

13. A method of encoding an input audio signal into a channel-independent representation comprising an output audio signal suitable for reproduction over a multiple loudspeaker system, the method comprising:

receiving the input audio signal comprising a plurality of individual channels, N;

defining a space D covering a target audience and partitioning the space D into a plurality of portions k independent from the plurality of channels N;

generating at least one spatial presence factor m for each combination of input audio and portion k, wherein each factor m quantifies a degree of presence of each input audio signal into each portion k of space D; and mapping the input audio signal to the output audio signal, for reproduction within the portions k, based on the value assigned to each spatial presence factor m.

14. The method of claim 13, further comprising:

generating metadata comprising the at least one spatial presence factor m; and associating the metadata with the output audio signal.

15. The method of claim 14, wherein the metadata associated with the output audio signal comprises information describing the space D surrounding the intended audience and a partition of space D into the plurality of portions, and wherein the input audio signals comprise only two individual channels of a stereo track, the method further comprising upmixing the two input audio signals to 4.0, 5.1 or 7.1 audio signals containing respectively four, six and eight channels, prior to the generation of the channel-independent representation.

* * * * *